US005960485A

United States Patent [19]

Mihara

[11] Patent Number: 5,960,485

[45] Date of Patent: Oct. 5, 1999

[54] BIDET

[76] Inventor: Kenji Mihara, Urban-kit 3F, 4-11 Tachibana-dori, Miyazaki 880, Japan

[21] Appl. No.: 09/083,377

[22] Filed: May 22, 1998

Related U.S. Application Data

[63] Continuation-in-part of application No. 08/849,817, filed as application No. PCT/JP95/02079, Oct. 6, 1995.

[30] Foreign Application Priority Data

Jan. 25, 1995 [JP] Japan ..... 7/44709
May 22, 1997 [JP] Japan ..... H9-170875

[51] Int. Cl.[6] ..... A47K 3/22

[52] U.S. Cl. ..... 4/443; 239/586; 251/321

[58] Field of Search ..... 4/420.4, 443, 448; 239/583, 586; 251/321; 604/246, 247, 249, 256

[56] References Cited

U.S. PATENT DOCUMENTS 591,228 10/1897 Goltermann ..... 251/321
2,033,620 3/1936 Fowler ..... 251/321

FOREIGN PATENT DOCUMENTS 2061934 3/1993 Canada ..... 4/443
355903 7/1922 Germany ..... 251/321

*Primary Examiner*—Henry J. Recla
*Assistant Examiner*—Tuan Nguyen
*Attorney, Agent, or Firm*—Sheridan Ross P.C.

[57] ABSTRACT

A bidet apparatus for washing of the vagina wall and the pudendum of a woman is disclosed. The bidet includes a contoured grip section that allows a user to easily grasp and operate the apparatus. A spout nozzle is connected to a water supply conduit for spouting water from a faucet or water supply. A valve mechanism is connected between the faucet or water supply and the washing water conduit and allows a user to control the flow of water from the spout nozzle. The valve mechanism includes a first chamber connected to the faucet or water supply and a second chamber connected to the washing water conduit. The second chamber is located within the first chamber. A valve core is provided that seals the first chamber from the second chamber. A valve shaft is provided that allows the user to selectively connect the first chamber with the second chamber and control the water flow from the spout nozzle.

15 Claims, 2 Drawing Sheets

BIDET

REFERENCE TO RELATED APPLICATIONS

This application is a continuation in part of U.S. Application Ser. No. 08/849,817 which is a U.S. National Phase filing of PCT Application No. PCT/JP95/02079 which is based on Japanese Application No. JP 95-44709. This application also claims priority under 35 U.S.C. §119 from JP 97-170875. All of the aforementioned applications are incorporated herein by reference in their entirety.

FIELD OF THE INVENTION

This invention is related to a bidet apparatus used to wash the wall of the vagina and the pudendum of a woman. More particularly, the present invention relates to a valve mechanism having features to control the flow rate of washing water which flows inside the bidet apparatus.

BACKGROUND OF THE INVENTION

In PCT/JP95/02079, a bidet apparatus is shown that is used for washing the vagina wall and the pudendum of a woman. The bidet apparatus can be installed on a bathroom faucet and so on.

The bidet apparatus of the above PCT application comprises a grip section having a washing water conduction pipe therein, and a spout nozzle having spout holes to spout washing water provided from a faucet. The washing water conduction pipe branches from a watering route of the faucet and the spout nozzle is fitted on a free end of the grip section. A valve mechanism is provided to control the flow rate of washing water. The valve mechanism comprises a valve rod and a washing water conduction hole bored through the valve rod. Whereby, the flow rate of washing water is controlled by movement of the valve rod and the washing water conduction hole.

SUMMARY OF THE INVENTION

The subject matter of the present invention is to provide a bidet that allows control of the flow rate of the washing water spouting therefrom. Moreover, the bidet of the present invention provides a user with better control of the wash water. The water leakage is prevented by utilizing wash water pressure in the valve mechanism.

The bidet apparatus of the present invention comprises a grip section having a washing water conduction pipe, therein. The washing water conduction pipe is a branched water route of a faucet. A spout nozzle is provided having spout holes to spout the washing water sent from the faucet. A valve mechanism controls the supply of wash water to the spout nozzle. The valve mechanism further comprises an outer cylinder having a top and bottom which are closed. An inner cylinder is disposed in said outer cylinder. The top of the inner cylinder is closed and bottom end is open. A valve core opens or closes the valve when a user touches and releases the bottom end of the inner cylinder. A valve shaft is provided for pushing the valve core through the tops of the outer cylinder and inner cylinder. A spring is disposed between the valve core and the bottom of the outer cylinder. The spring presses the valve core toward the bottom end of the inner cylinder. A water supply pipe connects to the water route of the faucet and communicates inside of the outer cylinder. The washing water conduction pipe communicates with the inside of the inner cylinder.

In another embodiment, a bidet apparatus is provided for connecting to a water supply. The bidet includes means for gripping and means for conducting water positioned within said means for gripping. A means for spouting water is provided wherein the means for spouting has at least one spout hole. The means for spouting water connected to the means for conducting water. A means for controlling a flow of water from the water supply to the means for spouting water is included and is a interconnected between the means for conducting water and the water supply.

The means for controlling includes a first chamber connected to water supply. A second chamber is provided and is connected to the means for spouting. The second chamber is disposed within the first chamber, and a means for selectively connecting the first chamber with the second chamber is provided such that fluid flows from the first chamber to the second chamber and exits from the means for spouting.

DETAILED DESCRIPTION

In the bidet of the present invention, the valve mechanism provides more control and less water leakage than a conventional bidet. Generally, the valve mechanism comprises an outer cylinder. An inner cylinder is positioned within the outer cylinder and a valve core is used to open and close communication between the outer and inner cylinders.

The outer cylinder includes a top and bottom that are tightly closed. In addition, the outer cylinder communicates with a water supply pipe. The inner cylinder is disposed in the outer cylinder and has a top that is tightly closed. The bottom end of the inner cylinder opens and closes with the valve core, thereby controlling a spout of washing water from the spout nozzle. The wash water is supplied from the faucet and flows through the outer cylinder, the inner cylinder and the washing water conduction pipe, to spout from the spout nozzle.

The valve core opens the bottom end of the inner cylinder by pushing down the valve shaft. The spring presses the valve core up to close the bottom end of the inner cylinder. Since the valve core moves up and down in the same direction as pushing direction of the push button of the bidet, an unreasonable force is not required for the operation of valve mechanism. As such, easy operation of the valve mechanism is obtained.

Furthermore, the water leakage is prevented by sufficient closure. Since the top of the valve core is shaped to approximate a cone, the water pressure forces the valve core to the closed position. As such, wash water never suddenly spouts from the spout nozzle, even at high water pressures or wash water surges.

Embodiment 1

Figure 1:
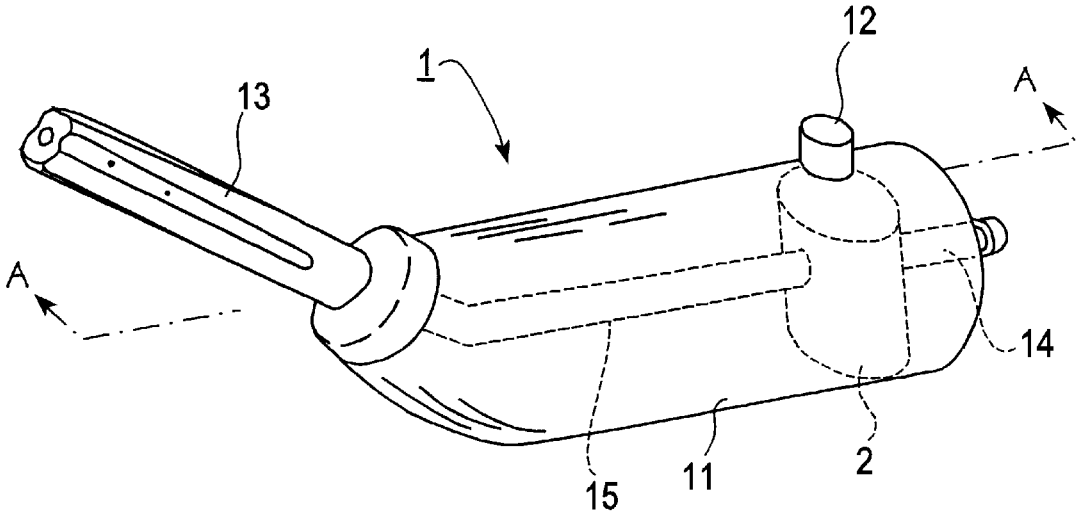
FIG. 1 is the perspective view of the bidet of the present invention.

As shown in FIG. 1, the bidet apparatus of the present invention includes a bidet 1 having a grip section 11. A spout nozzle 13 is used for spouting wash water and is fitted on the free end of the grip section 11. A push button 12 controls the flow rate of wash water. A water supply pipe 14 connects to a faucet (not shown in the drawings). A valve mechanism 2 controls the flow rate from a water supply pipe 14 by the operation of a push button 12, and a washing water conduction pipe 15 which communicates with a valve mechanism 2 and a spout nozzle 13. The washing water conduction pipe 15 may include a tube positioned within the grip section 11 or may be integrally formed in the grip section 11 during manufacturing.

Figure 2A:
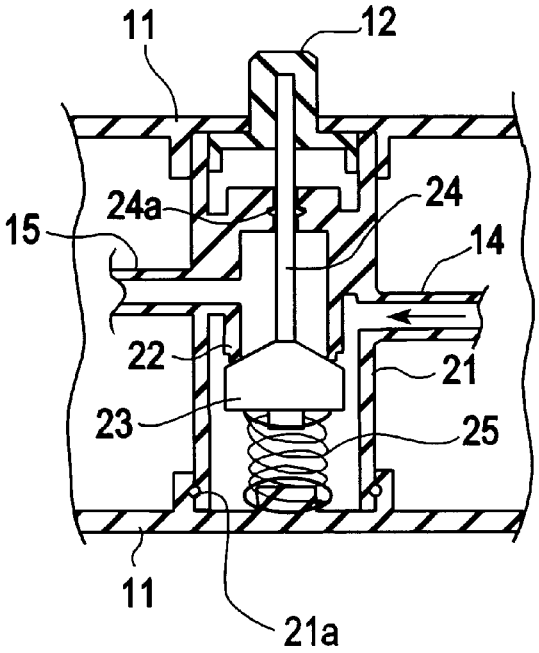
FIG. 2*a* is the A—A section view in part of FIG. 1, showing detailed operation of the valve mechanism of the present invention.
Figure 2B:
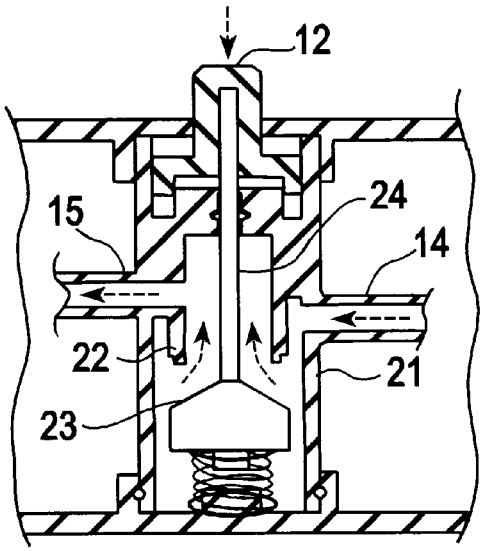
FIG. 2*b* is the A—A section view in part of FIG. 1, showing detailed operation of the valve mechanism of the present invention.

As shown in FIG. 2(*a*), valve mechanism 2 comprises an outer cylinder 21 which communicates with water supply pipe 14, and an inner cylinder 22 which communicates with washing water conduction pipe 15. A valve core 23 controls the flow rate of wash water by attaching with the bottom end of inner cylinder 22. A valve shaft 24 connects with push button 12 to allow a user to depress the valve core 23. A spring 25 is provided which forces the valve core 23 upwardly to close the bottom end of inner cylinder 22.

The top and bottom of the outer cylinder 21 are tightly closed and the inner cylinder 21 is disposed therein. The bottom end of inner cylinder 22 is open and the top is tightly closed. The communication between outer cylinder 21 and inner cylinder 21 is controlled by upward and downward movements of the valve core 23.

The valve core 23 is cone-shaped and closes the inner cylinder 22 in such a manner that the upper part of valve core 23 is positioned into the inside of inner cylinder 22. O-ring 24*a* is provided between valve shaft 24 and inner cylinder. In addition, an O-ring 21*a* is provided between grip section 11 and bottom end of outer cylinder 21.

The water control mechanism is hereby described. As shown in FIG. 2(*a*), when the faucet is opened, wash water flows into outer cylinder 21 via water supply pipe 14. Before push button 12 is depressed, the valve core 23 closes the bottom end of inner cylinder 22, and the water route to outer cylinder 21 is shut. Therefore, the wash water does not flow into washing water conduction pipe 15 in this position.

As shown in FIG. 2(*b*), when using bidet apparatus, a user may depress core 23 by pressing the push button 12 which is connected to valve shaft 24. Preferably, the user uses a thumb on the gripping hand to press the push button 12. As a result of this pressure, the valve core 23 releases from the bottom end of inner cylinder 22 causing wash water to flow into the washing water conduction pipe 15 from outer cylinder 21 via inner cylinder 21.

To stop or to reduce the flow rate of wash water, the push button 12 can be released or pressure on the button 12 can be reduced. Thereby, spring 25 forces the valve core 12 back to the closed or "near" closed position.

Accordingly, since the valve core 23 moves in the same direction as the pressing direction of push button 12 during the flow rate control, easy operation and sufficient closure of valve are obtained via the use of thumb pressure. Since the upper part of valve core 23 is cone-shaped having a gradually attenuated diameter, the water pressure forces the valve core 23 to close inner cylinder 22. As a result, sudden surges in water pressure act to close valve core 23. This closure prevents water from suddenly exiting the spout nozzle 13. Therefore, due to the structure and shape of valve core 23 and the resiliency of spring 25, water leakage is more efficiently prevented using this diameter.

The upper part of valve core 23 was formed as a cone in the above embodiment. However, this invention should not be limited by this shape. The valve core, may have other shapes, such as a whole conical shape, curved surface or any other shape that can obtain same effects, as previously described. For example, in another embodiment, valve core 23 can have a spherical, semi-spherical or hemispherical shape. The circular shape also provides a tightness of valve mechanism to maintain the upper part of valve core 23 into inner cylinder 22.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described herein and above is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. A bidet apparatus for connecting to a faucet, said bidet comprising:

a grip section;

a washing water conduit positioned within said grip section;

a spout nozzle having at least one spout hole, said spout nozzle connected to said washing water conduit; and a valve mechanism connected to said washing water conduit and adapted to be connected to said faucet wherein said valve mechanism controls a supply of wash water from said faucet to said spout nozzle;

said valve mechanism including:

an outer cylinder having a bottom portion and defining a first chamber fluidly connected to said faucet;

an inner cylinder disposed within said outer cylinder, said inner cylinder having an open bottom portion and defining a second chamber;

a valve core for contacting said open bottom portion of said inner cylinder to seal said second chamber;

a valve shaft connected to said valve core wherein said valve shaft is slidably disposed within said inner cylinder;

a spring disposed between said valve core and said bottom of said outer cylinder, said spring biasing said valve core toward said open bottom portion of said inner cylinder to seal said first chamber from said second chamber, wherein pressure placed on said valve shaft causes said spring to compress and said valve core to disengage from said bottom portion of said inner cylinder to fluidly connect said first and second chambers; wherein said grip section has first and second seat portions of housing a top portion and bottom portion of said outer cylinder.

2. The bidet, as claimed in claim 1, wherein said grip section is contoured for gripping by a hand of a user.

3. The bidet, as claimed in claim 1, wherein said washing water conduit is integrally formed within said grip section.

4. The bidet, as claimed in claim 1, wherein said spout nozzle is connected to said grip section.

5. The bidet, as claimed in claim 1, wherein said valve mechanism is positioned within said grip section.

6. The bidet, as claimed in claim 1, wherein said valve mechanism further comprises:

a contoured button connected to said valve shaft.

7. The bidet, as claimed in claim 6, wherein said valve shaft comprises:

first and second ends wherein said first end is connected to said contoured button and said second end is connected to said valve core.

8. The bidet, as claimed in claim 1, wherein said valve mechanism further comprises:

a seal positioned on an outer surface of said outer cylinder at said bottom portion wherein when said bottom portion is housed within at least one of said first and second seat portions a seal is created between said outer surface of said outer cylinder and at least one of said first and second seat portions.

9. The bidet, as claimed in claim 8, wherein said seal is an O-ring disposed around said outer surface of said outer cylinder.

10. The bidet, as claimed in claim 1, wherein said washing water conduction pipe is a branched water route of said faucet.

11. The bidet, as claimed in claim 1, wherein said inner cylinder further comprises:

a seal for contacting said valve shaft.

12. The bidet, as claimed in claim 11, wherein said seal is an O-ring disposed around said valve shaft.

13. The bidet, as claimed in claim 1, wherein said valve core has a conical shape.

14. The bidet, as claimed in claim 1, wherein said valve core is composed of a polymeric material.

15. The bidet, as claimed in claim 1, wherein said valve core is composed of a rubber material.

* * * * *

UNITED STATES PATENT AND TRADEMARK OFFICE

CERTIFICATE OF CORRECTION

PATENT NO. 5,960,485
DATED October 5, 1999
INVENTOR(S) Mihara

It is certified that error appears in the above-indentified patent and that said Letters Patent is hereby corrected as shown below:

In Claim 1, line 24, please delete "of" and insert --for-- therefor.

Signed and Sealed this

Sixth Day of June, 2000

*Attest:*

Q. TODD DICKINSON

*Attesting Officer*

*Director of Patents and Trademarks*